United States Patent [19]

Humphreys et al.

[11] Patent Number: 4,849,999

[45] Date of Patent: Jul. 18, 1989

[54] LAUNDRY TRANSFER AND COUNTING APPARATUS

[75] Inventors: Jerry W. Humphreys, Tuscon, Ariz.; Michael S. Radler, Jeffersonville, Pa.

[73] Assignee: Markman and Associates, Conshohocken, Pa.

[21] Appl. No.: 91,003

[22] Filed: Aug. 31, 1987

[51] Int. Cl.[4] ..... G06M 3/08; B07C 5/36

[52] U.S. Cl. ..... 377/6; 377/53; 209/551; 209/906; 209/937; 235/98 C

[58] Field of Search ..... 377/6, 53; 209/551, 209/906, 937; 235/98 C

[56] References Cited

U.S. PATENT DOCUMENTS

| | | | |
|---|---|---|---|
| 1,872,258 | 8/1932 | Elberty, Jr. | 209/937 |
| 3,327,942 | 6/1967 | Blume | 235/98 C |
| 3,373,869 | 3/1968 | Burson, Jr. | 209/3.1 |
| 3,388,260 | 6/1968 | Boon | 377/6 |
| 3,415,372 | 12/1968 | Drace | 209/551 |
| 3,478,316 | 11/1969 | Block et al. | 235/385 |
| 3,648,054 | 3/1972 | Nance | 377/6 |
| 3,876,075 | 4/1975 | Wesner | 209/551 |
| 4,136,778 | 1/1979 | Wortman et al. | 209/937 |
| 4,484,066 | 11/1984 | DeBlieux et al. | 377/6 |
| 4,550,246 | 10/1985 | Markman | 235/385 |

*Primary Examiner*—John S. Heyman

*Attorney, Agent, or Firm*—Panitch, Schwarze, Jacobs and Nadel

[57] ABSTRACT

The invention includes an apparatus for and method of moving textile articles such as pieces of laundry or the like comprising an enclosed passageway having two opposing open ends, and at least one bend between the two open ends; a vacuum source coupled with one of the two open ends and developing a subatmospheric pressure along the passageway and at the other open end of the passageway to draw textile articles into the other open end and through the passageway to the one open end; and a sensor located at the one bend and sensing textile articles drawn through the passageway. The sensor is coupled with an appropriate counter for accumulating a count of successive textile articles drawn through the passageway. A delay circuit is included between the sensor and the accumulator to inhibit successive detector outputs for a selectable but fixed time period, regardless of the size of the textile articles being passed and counted. The subatmospheric pressure developed at the remote open end of the passageway initially receiving the textile articles is sufficient to lift up into the open end and draw through the passageway articles raised to just beneath that opening.

9 Claims, 3 Drawing Sheets

LAUNDRY TRANSFER AND COUNTING APPARATUS

FIELD OF THE INVENTION

This invention relates to apparatus and methods for transporting and counting articles, and, in particular, for transporting and counting textile articles to be laundered or dry cleaned, such as garments and linens.

BACKGROUND OF THE INVENTION

In the past, laundry sorting in commercial facilities has required either a great deal of manual labor or fairly complicated equipment.

The commercial laundering and cleaning of articles, particularly in the linen supply field, require an accurate count of the number of articles being handled. The methods presently employed for counting articles vary from strictly manual sorting and counting to sophisticated devices which automatically sense, differentiate and count different types of articles based upon the presence of markers or tags on the articles.

Strictly hand-processing of laundry is the least attractive method. The workers employed for such tasks typically have low-skill levels and low interest in maintaining accurate counts. Inaccurate counts lead to inventory losses and customer dissatisfaction.

At the other extreme, certain sophisticated systems exist for essentially automatically processing pieces of laundry. All such systems require the provision of some type of a coding tag on the individual laundry pieces which can be detected by an appropriate sensor scanning each of the pieces as it is passed by the sensor.

One of the disadvantages of this type of system is that a marker must be provided on each laundry piece. This can be an expensive proposition where literally hundreds of thousands of pieces of inventory are involved. It may also not be a viable form of operation for commercial laundries serving retail laundry and cleaning establishments where privately-owned pieces of laundry are serviced. Each piece would require a tag. The tags either would have to be removed at the completion of processing, a significant labor cost, or, more likely, would not be removed and would be lost when the pieces were not returned for further cleaning. Another disadvantage is that even with such automatic counting systems, manual labor must still be employed to separate the pieces of laundry being fed past the sensors so that the sensors are not simultaneously confronted with multiple tags.

A less sophisticated type of automated counting system utilizes multiple belts on a 30 to 45 degree angle. Photoelectric eyes, or reed-type switches, are then used to count the articles as they pass up the belts. The materials-handling aspect of this type of system is one of its major weaknesses. Textile articles like linens have a tendency to roll back down the belts if the system is installed to accommodate tall cylindrical slings. Many times linens will jam on the dividing walls between the different lanes. The next piece of linen thrown down that lane will dislodge the jammed item, only to be miscounted as the piece goes through the counters as one piece. Often, the slings or carts will fill up, only to be ignored by the operator. This can cause a back-up on the belts, thus blocking the counting device. When the lane is cleared, or the sling moved, all linens then go into the new sling and are not counted.

A third approach has been to use a light frame. An operator selects articles of a single category (e.g. napkins or hand towels) from a load of mixed articles and throws them sequentially through the light frame which, with associated circuitry, registers and accumulates a count of the articles As each category is separated from the load and counted, the accumulated counts are noted.

One problem associated with light frame systems is the tendency for double counting. The frames typically employ a number of individual light beams, one or more of which may be broken at separate times by different portions of a single article thrown through the frame. Other sources of double counts arising with such frames are flying insects which may be attracted to dirty laundry and pieces of debris sometimes present with the laundry and thrown with the articles.

To prevent double counting, such systems typically have circuitry to provide a time delay between counts. However, the delay must be varied for individual pieces of laundry of different sizes and/or types. Thus, the delay for small pieces like hand towels and napkins is smaller than the delay used for larger pieces such as towels and still different from the delay needed for extremely large pieces such as sheets, tablecloths and blankets.

Another problem associated with light frame systems is that the operator must actually throw each article through the light frame with at least a minimum velocity. This is to insure that the programmed time delay is not exceeded and the pieces double counted. It is also necessary in commercial cleaning establishments to process the large numbers of laundry pieces which such establishments normally handle. This is extremely tiring work in the best of circumstances. Exhaustion of an operator towards the end of the shift can result in pieces being thrown insufficiently fast through the light frame and double counts occurring.

It would be very beneficial to provide a system and method for counting individual textile articles like pieces of laundry which do not require the use of special markers on the articles.

It would also be very beneficial to provide an apparatus and method for counting individual textile articles which is less prone to counting errors than are light frame and manual counting systems which do not use special markers or tags on each article.

It would be very beneficial to provide an apparatus and method for counting textile articles which minimizes double counts and missed counts.

It would further be beneficial to provide a method and apparatus for moving textile articles such as pieces of laundry, whether for counting purposes or otherwise, which is less physically taxing on the operators.

SUMMARY OF THE INVENTION

The invention is an apparatus and method for accomplishing the aforesaid benefits. In one aspect the invention is an apparatus for counting textile articles such as pieces of laundry comprising an enclosed passageway having two opposing open ends, and at least one bend between the two open ends; vacuum means coupled with one of the two open ends and developing subatmospheric pressure along the passageway and at the other open end of the passageway for drawing textile articles into the other open end and through the passageway to the one open end; and sensor means located at the one bend for sensing textile articles drawn through the passageway.

Another aspect of the invention is an apparatus for moving pieces of laundry comprising: an enclosed passageway having two opposing open ends; vacuum means coupled with one open end of the passageway for creating a subatmospheric pressure at the other open end of the passageway sufficient to lift up and draw into and through the passageway, individual textile articles positioned below the other open end of the passageway; and sensor means for detecting textile articles passing through the passageway.

The invention further includes the method of moving and counting pieces of laundry accomplished by the apparatus.

BRIEF DESCRIPTION OF THE DRAWINGS

The foregoing summary, as well as the following detailed description of the preferred embodiment of the invention, will be better understood when read in conjunction with the appended drawings For the purpose of illustrating the invention, there is shown in the drawings, an embodiment which is presently preferred. It is understood, however, that the invention is not limited to the precise arrangements and instrumentality shown. In the drawings.

DESCRIPTION OF THE PREFERRED EMBODIMENT

Figure 1:
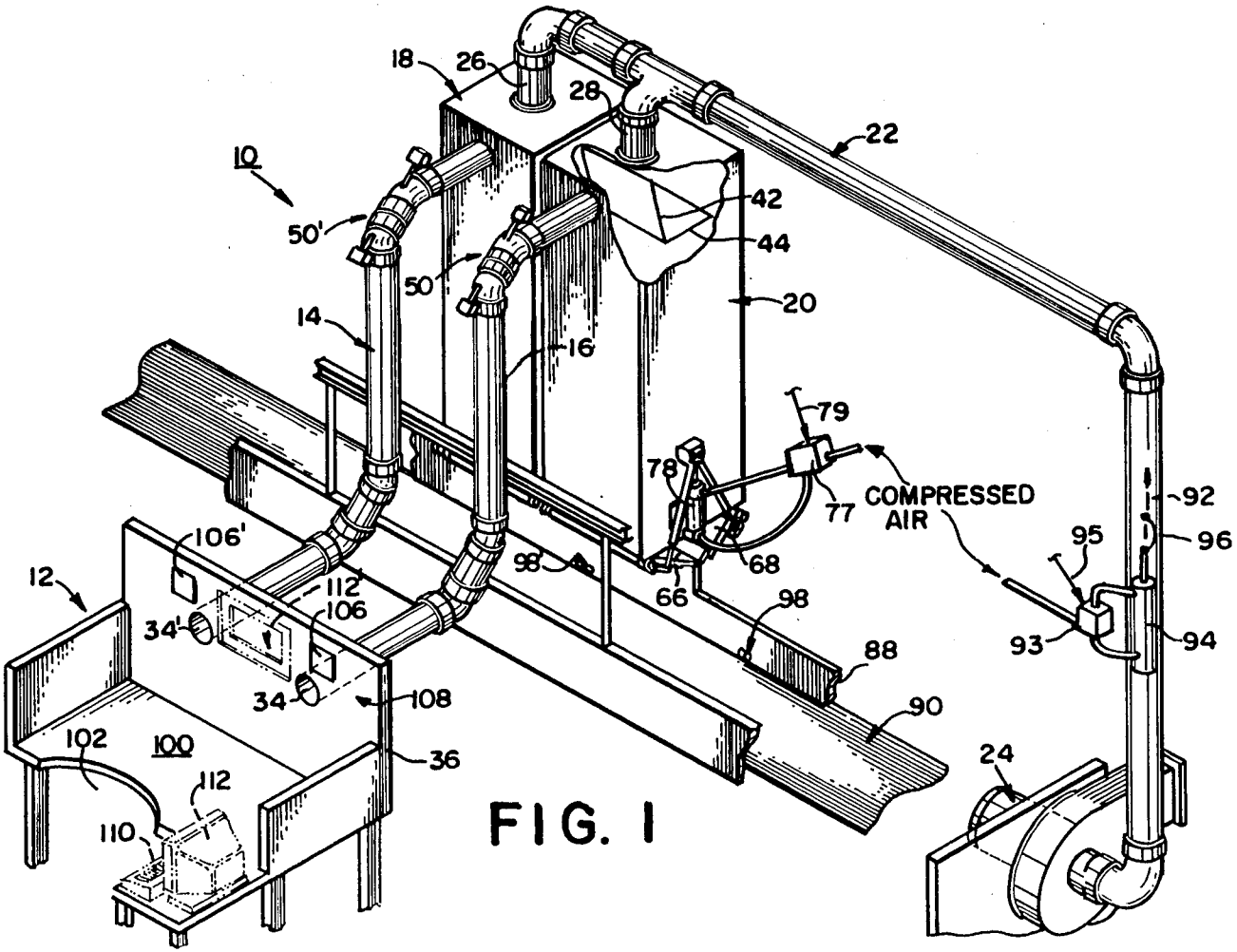
FIG. 1 is a diagrammatic, perspective, partially sectioned view of the preferred embodiment of the invention for simultaneously moving and counting two different categories of laundry pieces.
Figures 2, 3:
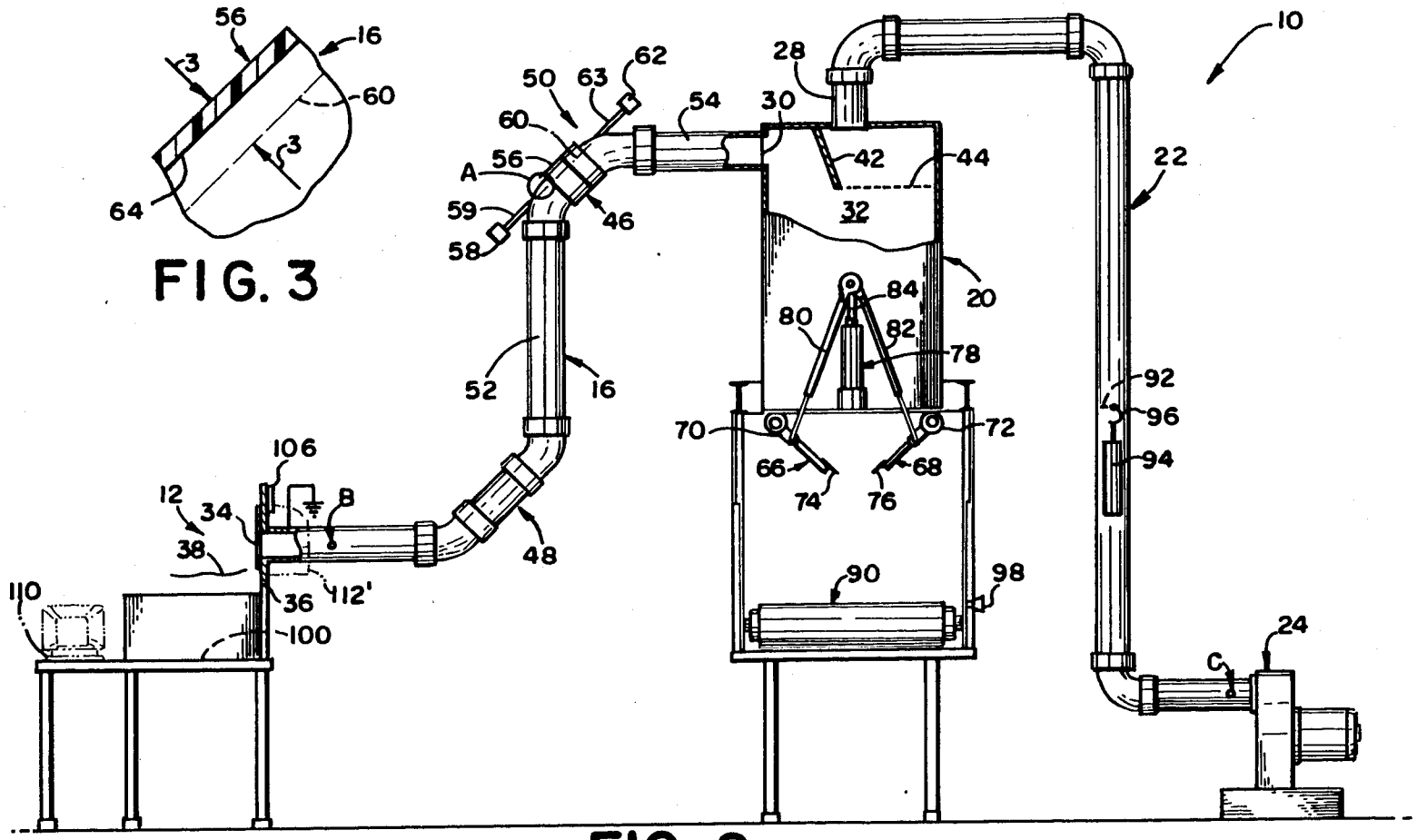
FIG. 2 is a diagrammatic, partially-sectioned, side elevation of the apparatus of FIG. 1.
FIG. 3 is a diagrammatic, side-elevation, expanded, localized section view of the apparatus of FIGS. 1 and 2 at area A in FIG. 2.

FIGS. 1 and 2 depict diagrammatically the preferred embodiment of the subject invention configured into an individual work station for concurrently transporting and counting two separate types of pieces of laundry. The entire apparatus is generally designated as 10. The apparatus 10 includes an operator sorting and counting work station, indicated generally as 12. A pair of vacuum tubes according to the subject invention, indicated generally at 14 and 16, respectively, extend from the work station 12 to a pair of substantially identical accumulator bins 18 and 20, respectively. Each of the accumulator bins 18 and 20 is coupled through a main vacuum line 22 to a vacuum means in the form of a vacuum blower 24. The main vacuum line 22 includes a pair of branch vacuum lines 26 and 28 for actually connecting the main line 22 with each of the accumulator bins 18 and 20, respectively.

Each of the vacuum tubes 14 and 16, with its associated accumulator bin 18 and 20, respectively, and the vacuum blower 24 comprises an apparatus of the invention for moving pieces of laundry. Referring to FIG. 2 where the vacuum tube 16 and its accumulator bin 20 are shown, the apparatus for moving pieces of laundry comprises an enclosed passageway for conducting pieces of laundry formed by the hollow interior of the vacuum tube 16. The passageway formed by the vacuum tube 16 interior has two opposing open ends. One open end opens into the hollow interior 32 of the accumulator bin 20. Another open end 34, opposing the one end 30, extends through a support panel 36 at the work station 12. The vacuum blower 24 is coupled with the one end 30 of the enclosed passageway through the accumulator bin 20, branch vacuum line 28 and main vacuum line 22. The vacuum blower 24, thus coupled to the one open end 30 of the vacuum tube 16 is operated to develop a subatmospheric pressure at the one open end 30 through the bin 20 and along the vacuum tube 16 to the other open end 34.

According to an important aspect of the invention, the subatmospheric pressure developed at the other open end 34 of the vacuum tube 16 is sufficient to raise up and into the other open end 34, individual textile articles, like a piece of laundry 38 illustrated diagrammatically in FIG. 2, when positioned below the other open end 34 of the vacuum tube 16 in the proximity of that other open end 34.

To achieve this result with respect to textile articles of varying sizes, ranging from the smallest washcloths to the bulkiest pieces of laundry normally processed such as thermal blankets, it is suggested that the vacuum blower 24 and remainder of the apparatus be operated so as to develop a subatmospheric pressure within the tube 16 of at least about 7 inches of water less than ambient atmosphere pressure at point B in FIG. 2, within about 4 inches from the other open end 34 of the vacuum tube 16 when that tube 16 is empty of laundry. In the described apparatus this is accomplished by developing a subatmospheric pressure of at least about 15 inches of water in the main vacuum line 22 near the blower 24 at point C again when the tube 16 is empty.

Individual pieces of laundry like the piece 38 drawn into the vacuum tube 16 pass the entire length of the vacuum tube between the two open ends 30 and 34 to the associated accumulator bin 20. The individual pieces of laundry drawn into the hollow interior 32 of the bin 20 are deflected downward into the bottom of the bin 20 by a plate 42 positioned opposite the one open end 30 of the vacuum tube 16. A screen 44 prevents pieces of laundry in the bin 20 from being drawn further into the branch vacuum line 28.

Still referring to FIG. 2, the vacuum tube 16 is provided with a pair of bends indicated generally at 46 and 48 to extend the length of the vacuum tube 16 from the work station 12 to the top of the accumulator bin 20. According to another important aspect of the invention, sensor means indicated generally by reference numeral 50 is located at the one bend 46 connecting first and second substantially straight sections 52 and 54, respectively, of the vacuum tube 16. The bend 46 connecting the two straight sections 52 and 54 itself includes a third straight section 56. Preferably, the sensor means 50 comprises an infrared emitter 58 which transmits a beam of infrared energy indicated by diagrammatically by broken line 60 from one end of the first straight section 52 of the vacuum tube along the third straight section 56 to an infrared detector 62 mounted at an end of the second straight section 54 adjoining the third straight section. The detector 62 is thus separated from the emitter 58 along the length of the third straight section 56 of the vacuum tube 16, and aligned with the emitter 58 for sensing the beam 60. It is also preferred for proper operation of the invention that the emitter 58 and detector 62 be mounted to the vacuum tube 16 so that the beam 60 is substantially parallel to and within about one inch of the upper sidewall portion of the vacuum tube 16 forming the third straight section 56 as is depicted in FIG. 3. The distance between the beam 60 and the upper inner sidewall 64 of the vacuum tube 16 in the third straight section 58 is indicated by the arrows 3—3. Each laundry piece is sensed when it breaks the beam 60 while being drawn along the vacuum tube 16.

The advantages of infrared optical systems for detection in an environment like a laundry are well known to those of ordinary skill in the art. The emitter might be, for example, an SE61E IR emitter while the detector might be, for example, an SE61R IR receiver, both available from Banner Engineering Corp., Minneapolis, Minn.

Referring to both FIGS. 1 and 2, the accumulator bin 20 is closed except for a pair of adjoining doors 66 and 68, respectively, shown in a partially open position at the bottom of the bin. Referring to FIG. 2, each door 66 and 68 is pivotally connected at one end 70 and 72, respectively, for opening outwardly from the bottom center of the bin 20 and for closing in a reverse manner. The free, adjoining end of each of the doors 66 and 68 is provided with a flexible seal strip 74 and 76, respectively, for sealing the bottom of the bin 20 when the doors 66 and 68 are closed. An air cylinder 78 is mounted by suitable bracketry above the doors 66 and 68 to open and close the doors 66 and 68. Each one of a pair of linkage arms 80 and 82 is pivotally connected at one end to the piston arm 84 of the air cylinder 78 and at an opposing end to one of the doors 66 and 68, respectively. Pressurizing one side of the air cylinder 78 causes the piston arm 84 to extend vertically and draw the doors 66 and 68 snug against the bottom framework of the bin 20 sealing the bin 20. Pressurizing an opposing side of the air cylinder 78 causes retraction of the piston arm 84 allowing the doors 66 and 68 to swing to a vertical, fully opened position (not depicted). Pieces of laundry accumulated in the bin 20 are dropped onto a conveyor 90 and are carried away from the bin 20 for further processing. Control of the pressurization of either side of air cylinder 78 is through a valve 77 responsive to an electric signal on line 79 to direct compressed air to one of the two sides of cylinder 78 (see FIG. 1).

To assist in the unloading of the accumulator bins 18 and 20, a damper 92 is provided in the main vacuum line 22 and is actuated by an associated air cylinder 94 through a suitable mechanical linkage like a bell crank. When the bin 20 is opened, the cylinder 94 rotates the damper 92 to a closed position as is indicated in phantom in FIG. 2, diminishing the vacuum created in the bins 18 and 20, thereby releasing the doors 66 and 68 and the pieces of laundry collected in the bottom of the bins. When the bin 20 is emptied, the doors 66 and 68 are again closed by pressurization of the air cylinder 78 and the servo 94 rotates the damper 92 to an open position allowing a greater vacuum (i.e. lower subatmospheric pressure) to be again created in the bin 20 and connected vacuum tube 16.

Control of the pressurization of air cylinder 94 is also provided through a valve 95, responsive to an electric signal on line 95 to direct compressed air to either side of the cylinder 94 (see FIG. 1).

If desired, suitable means such as a sensor 98 can be positioned at or slightly upstream from the bin 20 to detect laundry on conveyor 90 to prevent bin 20 from being opened while other laundry loads are passing beneath the bin 20. For example, an SM812LV retroreflective IR sensor system by Banner may be used.

Work station 12 in FIGS. 1 and 2 includes a horizontal work platform 100 on which pieces of laundry or other articles are deposited for sorting by an operator. A cut-out 102 is provided to enable the operator to have access to the open end 34 of vacuum tube 16 and to an identical open end 34' of the other vacuum tube 14. The two vacuum tubes 14 and 16 and their associated bins 18 and 20, respectively, enable an operator at station 12 to concurrently sort at least two different types of laundry pieces for separate processing. The detector 50 in vacuum tube 16 and an identical detector 50' in vacuum tube 14 are each coupled through electronic circuitry with an accumulator display unit 106 and 106', respectively, at the work station 12. The system as described thus far can be controlled by the operator to count, dump and reset manually by means of a switch such as a key 108.

If desired, the apparatus 10 as described thus far could be made interactive with a computer. For computerizing several work stations, it is suggested that each station 12 be provided with a keyboard and display 110 and 112, respectively, indicated in phantom. An additional, identical display 112' can be provided between the accumulator displays 106 and 106' for operator convenience. The displays 112 and 112' would provide information to the operator in addition to the accumulator totals being displayed on the display units 106 and 106'.

Figure 4:
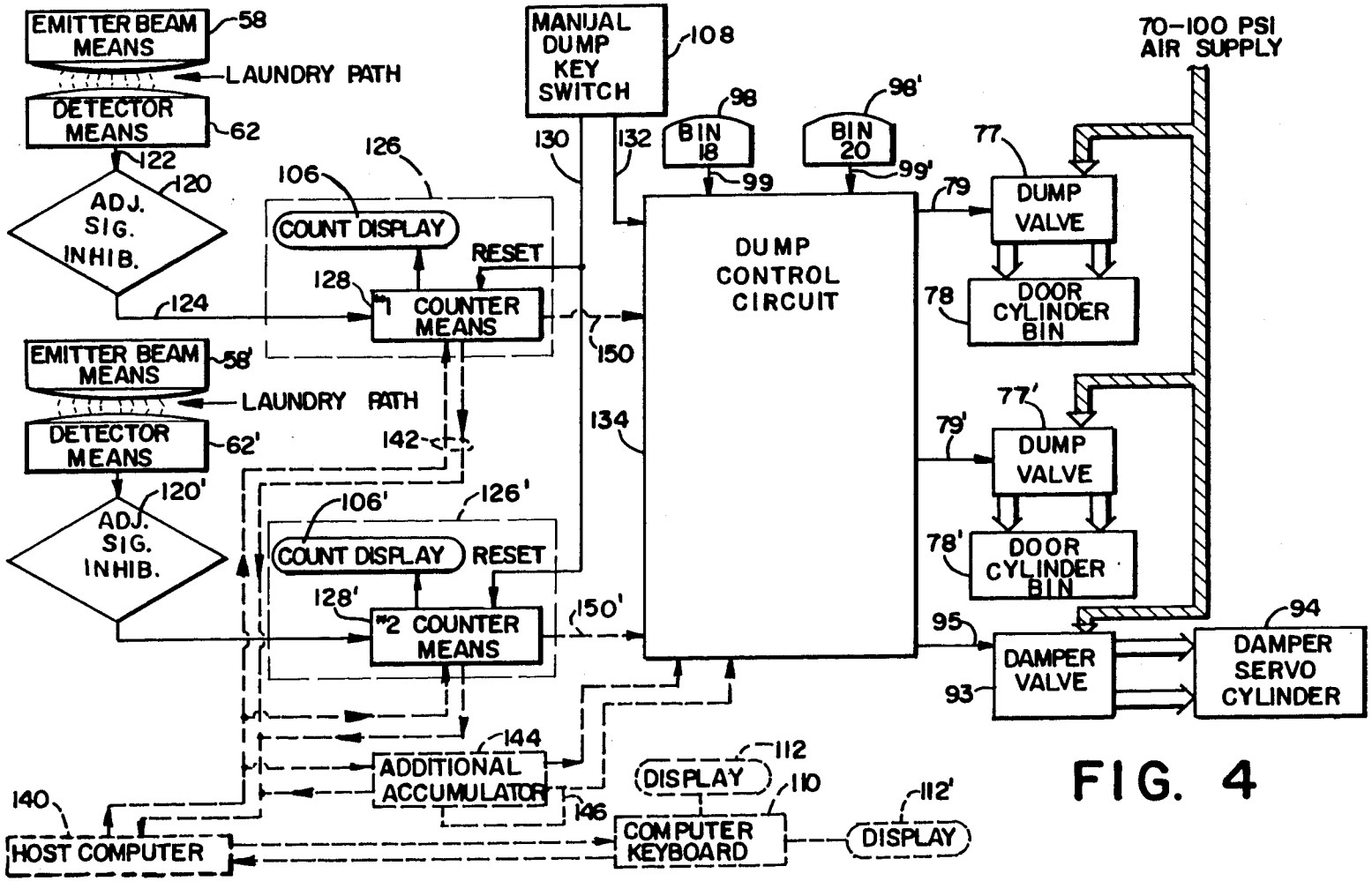
FIG. 4 is a schematic diagram of the control system associated with the apparatus.

The emitters 60 and 60', accumulator displays 106 and 106', additional displays 112, 112' and keyboard 110, when provided, as well as the valves 77 and 93 controlling air cylinder 78 and damper servo cylinder 94 are interconnected through control circuitry depicted diagrammatically in FIG. 4. Referring to FIG. 4, the operation of the system will be described primarily with respect to the components associated with the vacuum line 16 and bin 20. Emitter and detector 58 and 62 are positioned along the vacuum tube 16 in a manner to output a substantially constant high level signal to an associated adjustable signal inhibitor 120 along a line 122. The inhibitor might be, for example, a B5RM1 non-modulated amplifier. The inhibitor 120 outputs a signal on line 124 which is carried to an accumulator 126 in response to the output of the detector means 62 going low on line 122 . The accumulator 126 includes a totalizing register 128 and an associated count display which is the count display 106 at the operator's station 12. The inhibitor 120 is adjustable so as to inhibit the generation of a second subsequent detection signal on the line 124 for a selectable, fixed period of time, regardless of the size of the piece of laundry passing through the apparatus. The B5RM1 also performs some high level filtering. A delay of about 15 milliseconds has been found satisfactory with this unit. The accumulator 126 might be a Slimline 3 ACT model from Nationwide Electronics Systems, Inc., Carpenterville, Ill. Articles passed through the second vacuum tube 14 are counted and accumulated in the same manner by identical components 58', 62', 120' and 126'.

When the operator has completed sorting the two classes of items fed into vacuum tubes 14 and 16, he can control the dumping of those bins and the resetting of the accumulators 126 and 126' by means of the manual key switch 108. Actuating the key switch 108 passes a signal along a first line 130 which resets each of the accumulator registers 128 and 128'. The key switch 108 further outputs a signal on line 132 to initiate a bin dumping operation by the dump control circuit 134. The dump control circuit 134 is a collection of adjustable duration relays which are responsive to the output of the dump key switch on line 132 and to the outputs of the conveyor sensors 98 and 98' on lines 99 and 99', if provided, to control the opening of the doors beneath bins 1 and 2 while contemporaneously closing the suction damper 92. In particular, after the key switch 108 has been activated, the dump control circuit waits until the conveyor beneath the bins 18 and 20 are clear, as indicated by the appropriate outputs on lines 99 and 99' from the conveyor sensors 98 and 98', before outputting a signal on line 79 to the dump valve 77 controlling the flow of compressed air to either side of the door cylinder 78 associated with bin 20. An identical signal is passed on a second line 79' to an identical dump valve 77' controlling a door cylinder 78' associated with bin 18. The dump control circuit 134 simultaneously outputs a signal on line 95 to the damper valve 93 controlling compressed air flow to either side of the damper servo cylinder 94. The adjustable relays of the dump control circuit 134 are adjusted so that the dump valves 77 and 77' and damper valve 93 are switched from their initial positions (closing the bin doors and opening the damper valve) to a dumping position (doors open, damper closed) for approximately the same period of time. For example, the dumping cycle might be about 4 seconds or more. The relays of the dump-control circuit 134 return the various valves 77, 77' and 93 back to their original position to restart another counting cycle.

As was indicated previously, if desired, the described system could be coupled with a host computer 140, indicated diagrammatically in FIG. 4. The host computer 140 might communicate with each accumulator 126, 126' and an additional accumulators 144 and 146, etc. which may be provided. Also coupled with the host computer 140 are the keyboard 110 and displays 112 and 112', if provided. The computer 140 could control the initiation of the dump control circuit through the accumulator such as along lines 150 and 150' or, preferably, by a separate line, not indicated, directly with the dump control circuit 134. The host computer 140 might be a dedicated microprocessor or a larger system providing other processing facilities for the user.

Operation of the apparatus 10 is as follows. Laundry pieces for sorting and counting are deposited upon the platform 100. In the manual mode, the operator hits the key switch 108 to initialize the displays. Where a computer is provided, the operator may enter an account number for the pieces into the microprocessor 140 through the keyboard 110. Entering a new account number automatically zeros accumulators 126 and 126' associated with each of the vacuum tubes 14 and 16. The operator selects the two different types of laundry pieces which are to be sorted and counted, and raises each selected piece to just below the appropriate one of the two open ends 34 and 34' counting that type of piece. The subatmospheric pressure developed at the open end 34 or 34' raises the selected piece into the open end 34 or 34', and draws the piece into the tube 16 or 14, respectively. The piece is counted as it traverses the bend 46 or 46', respectively.

A very important aspect of the invention is the method in which pieces of laundry are counted. Referring to FIG. 2, the straight section 52 of the vacuum tube 16 between the upper bend 46 and lower bend 48 is elongated to permit the subatmospheric pressure being developed by the vacuum blower 24 to accelerate a piece of laundry 38 drawn through the tube 16 before encountering the upper bend 46. The momentum of the piece 38 causes it to impact against the sidewall 64 of the vacuum tube 16 at the bend 46. The velocity of the piece accelerated through the straight section 52 is abruptly changed. The sidewall 64 deflects the piece off at about a 45 degree angle from its original vertical direction. It is also believed that the piece is momentarily decelerated upon impacting the sidewall 64. The sidewall 64 of the third straight section 56 where the piece 38 impacts after being accelerated insures that the piece is positioned at the highest point in the vacuum tube 16 along the bend 46 to break the beam 60 so that the piece is detected. This orientation of the vacuum tube and emitter/detector pair 58, 62 further insures that the piece will remain at the highest portion of the bend 46 along the length of the bend 46 until passing beyond the detector 62.

It is estimated that the system can be designed to accelerate pieces of laundry drawn into the vacuum tube to at least about 70 miles per hour approaching the one bend 46 where the sensing takes place. Counting can be accomplished at lesser and greater velocities, however.

The vacuum tubes 16 and 18 and the main vacuum lines 22 and branches 26 and 28 are easily fabricated from commercially available sections of PVC tubing. For the apparatus 10 depicted, six-inch diameter tubing is suggested for the vacuum tubes 14 and 16 where various size article pieces must be handled. If only smaller pieces need be moved, four-inch diameter pipe might be used. Eight-inch diameter tubing sections are suitable for the main vacuum line 22, although if the length of that line gets too great, ten-inch diameter tubing may be preferred.

The bends at 46 and 48 are easily provided by use of a pair of joined 45 degree PVC bends.

Although a straight section 56 is provided by the use of a pair of 45 degree bends, a 90 degree bend has also been successfully operated. Thus, at least any angle between about 45 and 90 degrees would be suitable for abruptly changing the velocity of pieces passed through a vacuum tubes 14 and 16 to sense their presence.

It has recently been discovered that tremendous static electric charges are generated at the inlets 34 and 34' of the tubes 14 and 16. These static electric charges can adversely effect the operation of any system electronics located near those entrances, such as the accumulator circuits 126. Accordingly, it is suggested that electronic circuitry not be located near the inlets 34 and 34' or, if circuitry is located in that vicinity, that the tubes 14 and 16 in the vicinity of the openings 34 and 34' either be made of metal or include a metal insert which is grounded.

It is suggested that the openings 34 and 34' be flush with the support panel 36 and that the surface of the panel 36 be substantially planar with no protrusions. This is so that articles lifted up to just beneath either opening 34 and 34' and drawn into either of those openings will not be caught on any protrusion from the support panel 36 and will be drawn into the tubes 14 and 16 without any substantial hindrance. While the provision of a circular opening 34, 34' of diameter equal to the diameter of the tube 14 and 16 is suggested for simplicity of construction and acceptable functionality, it is envisioned that, if desired, the openings 34 and 34' may be coned to a larger diameter than the vacuum tubes 14 and 16.

From the foregoing it can be seen that the present invention provides an apparatus for and method of moving textile articles such as pieces of laundry quickly and easily and further enables accurate counting and accumulating counts of successive pieces moved. It will be recognized by those skilled in the art that changes could be made to the above-described embodiment of the invention without departing from the broad inventive concept thereof. It is understood, therefore, that this invention is not limited to the particular embodiment disclosed, but is intended to cover any modifications which are within the scope and spirit of the invention, as defined by the appended claims.

We claim:

1. An apparatus for counting textile articles such as pieces of laundry or the like comprising:

an enclosed passageway having two opposing open ends, and at least one bend between the two open ends;

vacuum means coupled with one of the two open ends for developing a subatmospheric pressure along the passageway and at the other end of the passageway to draw textile articles into the other open end and through the passageway to the one open end; and sensor means located at the one bend for sensing textile articles drawn through the passageway;

the one bend connecting two substantially straight sections of the passageway; and the sensor means comprising an emitter means mounted in one of the two straight sections for generating a beam of energy directed toward the other one of the two straight sections and a detector means mounted in the other one of the two straight sections for detecting the beam.

2. The apparatus of claim 1 further comprising counter means coupled with the sensor means for accumulating a count of successive textile articles drawn through the passageway.

3. The apparatus of claim 1 wherein the vacuum means develops a subatmospheric pressure of at least about 9 inches of water less than atmospheric pressure at the one end of the passageway when the passageway is empty.

4. The apparatus of claim 1 wherein the vacuum means develops a subatmospheric pressure within the passageway of at least about 7 inches of water less than ambient atmospheric pressure within about 4 inches from the other open end of the passageway when the passageway is empty.

5. The apparatus of claim 1 wherein said sensor means comprises:

emitter means for transmitting a beam of energy; and detector means separated from the emitter means along a length of the passageway at the one bend for sensing the beam.

6. The apparatus for claim 1 wherein the one bend is formed by a third substantially straight section of passageway connecting the two substantially straight sections of the passageway, and wherein the emitter means is oriented to project the beam of energy along the third straight section within about one inch of a sidewall of the third straight section of passageway.

7. The apparatus of claim 1 further comprising counter means coupled with the detector means for accumulating a count of successive textile articles drawn through the passageway.

8. The apparatus of claim 1 operated so as to create a subatmospheric pressure at the other open end of the passageway sufficient to lift up and draw into the passageway individual textile articles positioned below the open end.

9. The apparatus of claim 1 further comprising accumulator bin means for vacuum coupling the one open end of the passageway with the vacuum means and for receiving and collecting successive textile articles drawn through the passageway.

* * * * *